US005290031A

United States Patent [19]

Natsume

[11] Patent Number: 5,290,031

[45] Date of Patent: Mar. 1, 1994

[54] STRING PROTECTOR FOR A RACKET FRAME

[75] Inventor: Yoshihiro Natsume, Hamamatsu, Japan

[73] Assignee: Yamaha Corporation, Japan

[21] Appl. No.: 977,211

[22] Filed: Dec. 28, 1992

[30] Foreign Application Priority Data

Dec. 28, 1991 [JP] Japan ..... 3-113203

[51] Int. Cl.[5] ..... A63B 49/14

[52] U.S. Cl. ..... 273/73 D

[58] Field of Search ..... 273/73 R, 73 C, 73 D, 273/73 G

[56] References Cited

U.S. PATENT DOCUMENTS

| | | | |
|---|---|---|---|
| 3,642,283 | 2/1972 | Wilkens | 273/73 G |
| 3,908,995 | 9/1975 | Portz | 273/73 DX |
| 4,204,681 | 5/1980 | Hall, Jr. et al. | 273/73 GX |
| 4,314,699 | 2/1982 | Bayer et al. | 273/73 D |
| 4,614,626 | 9/1986 | Frerking | 273/73 DX |
| 4,765,620 | 8/1988 | Jones | 273/73 G |

FOREIGN PATENT DOCUMENTS

| | | | |
|---|---|---|---|
| 0241393 | 10/1987 | European Pat. Off. | 273/73 D |
| 2598323 | 11/1987 | France | 273/73 D |
| 2187392 | 9/1987 | United Kingdom | 273/73 D |
| 2191409 | 12/1987 | United Kingdom | 273/73 D |

*Primary Examiner*—William Stoll

*Attorney, Agent, or Firm*—Ostrolenk, Faber, Gerb & Soffen

[57] ABSTRACT

In construction of an attachment-type string protector for racket frames including a base strap and a number of sleeves aligned on the base strap, the base strap is made of a relatively rigid synthetic resin, and a number of tubular vibration absorbers made of a soft synthetic material are inserted into respective sleeves almost over the entire length of the latter in full surface contact with strings. Full surface contact of the vibration absorbers with the strings over an increased length assures high degree of impact damping at shooting balls.

10 Claims, 1 Drawing Sheet

STRING PROTECTOR FOR A RACKET FRAME

BACKGROUND OF THE INVENTION

The present invention relates to a string protector for a racket frame, and more particularly relates to improvement in impact damping of a racket frame used for tennis or the like.

A racket frame such as a tennis racket frame has a general construction in which a head connected to a handle has a substantially oval shape defining a face formed by a latticework of strings held in tension on the head. The head includes a frame top, a pair of lateral zones and a yoke forming a joint of the pair of lateral zones. The head is provided with the first group of through holes which extend substantially parallel to the longer axis of the oval shape and the second group of through holes which extend substantially parallel to the shorter axis of the oval shape. Each string in the latticework is held in tension in the through holes (string holes) in an arrangement such that, on the outer peripheral surface of the head, the string runs in the circumferential direction between adjacent through holes in a same group.

When a ball is shot at the face of a racket frame, impact caused by the shot develops intense vibrations on strings which tend to mar the life of the strings. In an attempt to kill, to say the least to reduce such undesirable vibrations on strings forming the face, a wide variety of string protectors have been proposed in the field.

An attachment-type string protector is one popular example of such conventional proposals. More specifically, such an attachment-type string protector includes a base strap made of a synthetic resin and adapted in shape for attachment to an outer peripheral surface of the yoke forming the proximal part of the head. This base strap is associated with a plurality of sleeves projecting in one body from the planar face of the base strap. The sleeves are aligned along the length of the base strap at positions corresponding to string holes in the yoke. A tubular soft material is tightly inserted into each sleeve and internally provided with one or more annular ribs. The soft material is used for absorption of string vibrations and generally shorter in dimension than the associated sleeve.

In a position attached to the yoke, the sleeve are received in corresponding string holes in the yoke and each string runs through respective sleeves in contact with the inserted soft materials via their annular ribs. In other words, the string is held in position in each sleeve through limited contact with the annular ribs of the associated fort material which is, as stated above, shorter than the sleeve into which it is inserted.

Presence of such a soft material in each sleeve is more or less effective in absorption of string vibrations. However, because of its shorter construction and limited line contact with a string, this attachment-type string protector is rather insufficient in ability of impact damping.

SUMMARY OF THE INVENTION

It is thus the primary object of the present invention to provide an attachment-type string protector which exhibits high degree of impact damping through enhanced absorption of string vibrations.

In accordance with the basic aspect of the present invention, a string protector is provided with a base strap made of synthetic resin, a plurality of sleeves projecting in one body from the base strap, and a corresponding number of vibration absorbers made of synthetic resin. The base strap is adapted in shape for attachment to the outer peripheral surface of the head of a racket frame. The sleeves are aligned along the length of the base strap at positions corresponding to string holes in the head. Each vibration absorber is inserted into each sleeve almost over the entire length of the latter.

In one preferred embodiment of the present invention, the base strap is adapted in shape for attachment to the outer peripheral surface of the yoke of a racket frame.

In another preferred embodiment of the present invention, the base strap is adapted in shape for attachment to the outer peripheral surface of the frame top.

DESCRIPTION OF THE PREFERRED EMBODIMENTS

Figure 1:
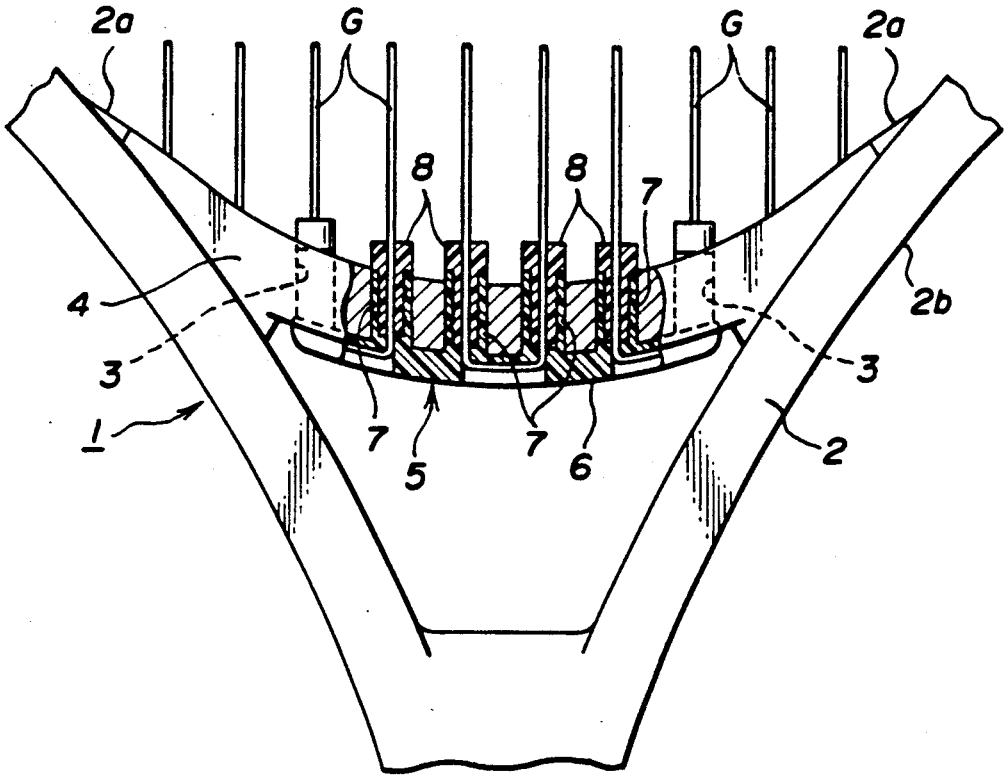
FIG. 1 is a fragmentary plan view, partly in section, of a racket frame associated with one embodiment of the string protector in accordance with the present invention.

FIG. 1 depicts one example of a racket frame associated with one embodiment of the string protector in accordance with the present invention. In the head 2 of the racket frame 1, more specifically in the yoke 4, there are formed lots of string holes 3 each extending between the inner and outer peripheral surfaces 2*a* and 2*b*. The string protector 5 in accordance with the present invention is attached to the outer peripheral surface 4*a* of the yoke 4.

Figure 2:
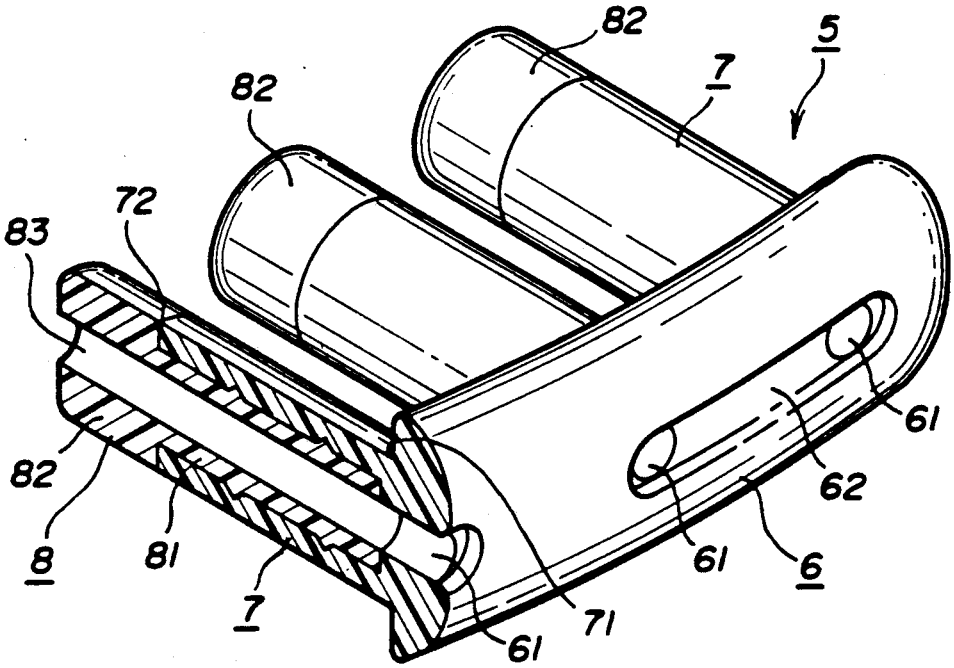
FIG. 2 is a perspective view, partly cut off, of the string protector shown in FIG. 1.

One preferable embodiment of the string protector 5 is shown in FIG. 2 in which the string protector 5 includes a base strap 6 made of a relatively rigid synthetic resin. The base strap 6 is adapted in shape for attachment to the outer peripheral surface 4*a* of the yoke 4. A plurality of sleeves 7 project in one body from one planar face of the base strap 6. The sleeves 7 are aligned along the length of the base strap at positions corresponding to the string holes 3 in the yoke 4 to which the string protector 5 is attached.

Each of a corresponding number of tubular vibration absorbers 8 is inserted into each sleeve 7. The vibration absorbers 8 are made of soft synthetic resin capable of absorbing string vibrations. The vibration absorber 8 is inserted into the sleeve 7 almost over the entire length of the latter. Stated otherwise, the inserted section 81 of the vibration absorber 8 extends almost from the proximal end 71 to the distal end 72 of the sleeve 7. The vibration absorber 8 is further provided with an exposed section 82 which extends beyond the distal end 72 of the sleeve 7. Preferably, the outer diameter of the exposed section 82 of the vibration absorber 8 is equal to that of the sleeve 7.

At positions corresponding to the string holes 3 in the yoke 4, the base strap 6 is provided with holes 61 for passage of a string G which are connected to each other by a longitudinal groove 62. The vibration absorber 8 is provided with an axial hole 83 which extends over the entire length of the vibration absorber 8 in flush communication with the above-described hole 61 in the base strap 6. Annular ribs 84 are formed on the inserted section 81 of the vibration absorber 8 for tight engagement with the associated sleeve 7.

In one actual example in production, the base strap 6 and the sleeves 7 are made of a synthetic resin having a flexural elasticity in a range from 100 to 300 Kg/mm$^2$. More specifically, they are preferably made of nylon, derlyn or carbonates. The vibration absorbers 8 are made of a synthetic resin having a flexural elasticity of 20 Kg/mm$^2$ or smaller, and more preferably of 5 Kg/mm$^2$ or smaller. Generally, rubbers, ABS resins or polyethylene resins are used therefor.

In the case of the foregoing embodiment, the string protector 5 is attached to the yoke 4 of the racket frame. Depending on real demand in use, however, the string protector may be adapted in shape for attachment to the frame top of a racket frame.

In a further variant, two sets of string protectors may be attached to the yoke and the frame top of a racket frame.

In accordance with the present invention, each string in the face latticework is wholly embraced by a vibration absorbable element, i.e. the vibration absorber 8, via full surface contact. As a consequence, high degree of impact damping is exhibited by the string protector in accordance with the present invention. In addition to the full surface contact, the increased length of the vibration absorbable element is also effective in impact damping.

I claim:

1. A string protector for a racket frame comprising a base strap made of synthetic resin and adapted in shape for attachment to an outer peripheral surface of a head of a racket frame, a plurality of sleeves projecting from a planar face of said base strap and aligned along the length of said base strap at positions corresponding to the positions of string holes in a racket head, and a corresponding number of tubular vibration absorbers made of synthetic resin and each inserted into each said sleeve almost over the entire length of said sleeve.

2. A string protector as claimed in claim 1 in which said base strap is adapted in shape for attachment to a yoke of a racket head.

3. A string protector as claimed in claim 2, in which said base strap with said sleeves is made of a synthetic resin having a flexural elasticity in a range from 100 to 300 Kg/mm$^2$.

4. A string protector as claimed in claim 2, in which said vibration absorbers are made of a synthetic resin having a flexural elasticity of 20 Kg/mm$^2$ or smaller.

5. A string protector as claimed in claim 1 in which said base strap is adapted in shape for attachment to a frame top of a racket head.

6. A string protector as claimed in claim 5, in which said base strap with said sleeves is made of a synthetic resin having a flexural elasticity in a range from 100 to 300 Kg/mm$^2$.

7. A string protector as claimed in claim 5, in which said vibration absorbers are made of a synthetic resin having a flexural elasticity of 20 Kg/mm$^2$ or smaller.

8. A string protector as claimed in claim 1 in which said vibration absorber has an exposed section extending beyond the distal end of said sleeves.

9. A string protector as claimed in claim 1, in which said base strap with said sleeves is made of a synthetic resin having a flexural elasticity in a range from 100 to 300 Kg/mm$^2$.

10. A string protector as claimed in claim 1, in which said vibration absorbers are made of a synthetic resin having a flexural elasticity of 20 Kg/mm$^2$ or smaller.

* * * * *